United States Patent [19]

Brazell, II

[11] Patent Number: 4,938,296

[45] Date of Patent: Jul. 3, 1990

[54] DRILL RIG ASSEMBLY

[75] Inventor: James W. Brazell, II, Atlanta, Ga.

[73] Assignee: Pacer Works, Ltd., Atlanta, Ga.

[21] Appl. No.: 256,699

[22] Filed: Oct. 12, 1988

[51] Int. Cl.[5] ..... F21B 7/02

[52] U.S. Cl. ..... 173/22; 173/28; 173/163; 173/164

[58] Field of Search ..... 173/164, 2, 39, 43, 173/163, 22, 28

[56] References Cited

U.S. PATENT DOCUMENTS

| | | | |
|---|---|---|---|
| 4,194,579 | 3/1980 | Bailey et al. | 173/164 X |
| 4,449,592 | 5/1984 | Mayer | 173/164 X |
| 4,703,811 | 11/1987 | Lam | 173/164 X |

*Primary Examiner*—Frank T. Yost

*Assistant Examiner*—Willmon Fridie, Jr.

*Attorney, Agent, or Firm*—Hurt, Richardson, Garner, Todd & Cadenhead

[57] ABSTRACT

A drill rig assembly adapted to be mounted on a vehicle and having a pivotal link assembly mounted to the vehicle. Attached in slidable relationship to the link assembly is a mast assembly containing feed means and rotary means fully enclosed within the mast assembly. An electronic level within the mast assembly automatically maintains the mast assembly in a predetermined, angular position. The drill rig assembly is capable of drilling either vertically or at selected, incremental angles. The drill rig assembly is designed to be safe in operation and lightweight, while providing performance characteristics of larger drill rigs.

18 Claims, 8 Drawing Sheets

DRILL RIG ASSEMBLY

BACKGROUND OF THE INVENTION

1. Field of the Invention

This invention relates to a drilling device and process, and is more particularly concerned with an hydraulically controlled drilling rig which is designed to be mounted onto various types of vehicles, and the process of using the same.

2. Description of the Prior Art

Hydraulically controlled drilling rigs are generally well known in the art, and have traditionally utilized similar structures within the various types of drills. The Acker Company of Scranton, Pa., has manufactured several various types of drill rigs, which rigs exemplify features that have not been significantly modified since the early part of this century. For example, the Acker ADII typifies one of the most commonly used drill rigs, employing features that are quite well known. This type of drill rig incorporates a derrick which supports two, parallel hydraulic cylinder feed assemblies. These feed assemblies raise and lower an exposed drill head by simultaneously applying force in the same direction to both the left side and right side of a support frame, which is integrally attached to the drill head. Because two feed assemblies are used in this manner, the drill head could be subjected to a turning force, perpendicular to the direction the drill head is moving, if the support frame was not incorporated to react the force provided by the two cylinders. Using two feed assemblies instead of one adds to the overall weight of the drill rig. This undesirable effect is augmented by the fact that the support frame for the rotary assembly is also required. Further, this twin feed assembly design, which incorporates redundant structure, necessitates a substantial support structure that requires a heavy, sliding base for movement onto on and off-hole positions. This structure requires that the drill rig be mounted on a large vehicle, which limits the rig's versatility. This drill rig additionally is designed to be used in vertical applications, only. Another critical limitation of this type of drill rig is that this design requires a heavy, square shaft, or Kelly bar, which acts as a drive shaft. This shaft is exposed and, therefore, is a safety hazard, and further adds to the weight of the device. Further, because the drill head slides on the outside of the feed cylinders, the drill rods are contained between the base supports for the feed cylinders. When the head is in a raised position, the distance between the base supports limits the size of the auger which can be driven by the device. Additionally, because of the arrangement of the hydraulic support jacks, the control panel for the rig cannot be placed along the rear of the rig at a safe distance from the rotating elements.

The Acker Core-Max drill rig utilizes a large, folding derrick which is raised and lowered by two double-acting hydraulic cylinders. The drive head is releasably mounted to a movable carriage that is slidably engaged with a mast mounted within the derrick. The feed cylinder is also mounted within the derrick in parallel, eccentric relationship to the drill rods, rather in direct, concentric alignment. Since the feed cylinder is not concentric with the drill rods, a bending moment results with respect to the force applied to the moving carriage. This results in less efficient application of force, and wear on the carriage and mast assemblies. This arrangement also requires a large amount of structural steel and, therefore, is a comparatively heavy rig with numerous parts. The rotation elements of the rotary assembly are also mostly exposed, providing a safety hazard.

The Acker Mountaineer drill rig incorporates many of the same features utilized by both devices previously discussed, including the dual, parallel feed assemblies, the large derrick, exposed rotating elements, control panel position close to the moving parts, and the heavy sliding base. Consequently, this design also has many of the same limitations referenced above.

The Acker Soil Sentry drill rig is an example of a relatively lightweight drill rig, however, it includes limitations such as feed assembly eccentric to the drill rods, support frame required to react the force applied by the feed assembly, exposed rotating parts, and limited performance characteristics which limit its applications.

SUMMARY OF THE INVENTION

Briefly described, the present invention includes a link assembly adapted to be mounted onto a vehicle. The link assembly is hydraulically actuated and carries a mast assembly in slidable engagement. The link assembly moves the mast assembly in selected positions, from a horizontal position in parallel relationship to the bed of the vehicle, to a vertical position, normal thereto. The link assembly is further adapted to move the mast assembly in on-hole and off-hole positions. The hydraulic control system is designed to be capable of automatically maintaining the mast assembly in a predetermined angled position while it is being moved on and off hole.

The mast assembly fully encloses the feed assembly, which effectively feeds the drill rods during the drilling operation, and also encloses substantially all of the rotary assembly which turns the drill rods. The enclosure of these elements improves the safety of the present invention over that of the prior drill rigs. The feed assembly is positioned so as to be concentrically aligned with the drill rods. All principal moving elements of the drill rig are powered hydraulically by pumps, mechanically linked to a power take off on the vehicle. The hydraulic circuit is especially designed with selection, speed and directional limitation means to provide for safe operation of the device.

In operation, actuation of the link assembly properly positions the mast assembly for drilling. During the drilling operation, the entire mast assembly moves relative to its slidable engagement with the link assembly. When the mast assembly reaches its lowermost position during drilling, it is then raised, and another section of drill rod is added. With a few exceptions, the entire operation is controlled from a single control panel. The invention is thus designed with a minimum of structural elements, so as to be relatively lightweight to permit it to be mounted onto a relatively small vehicle, for increased mobility and economy. The present invention, however, retains the performance characteristics of the larger drill rigs of the prior art.

Accordingly, it is an object of the present invention to provide a drilling apparatus and method for using the same which overcomes the above-referenced limitations of the prior art.

Another object of the present invention is to provide a drilling apparatus which is simple in structure, inexpensive to manufacture, durable in structure, and efficient in operation.

Another object of the present invention is to provide a drilling apparatus which is lightweight and capable of being supported by a relatively small vehicle.

Another object of the present invention is to provide a drilling apparatus which is designed for safe operation.

Another object of the present invention is to provide a drilling apparatus in which the feed cylinder assembly is concentric with the drill rods.

Another object of the present invention is to provide a drilling apparatus which utilizes a sliding mast assembly.

Another object of the present invention is to provide a drilling apparatus in which the rotary assembly is substantially enclosed within the mast assembly.

Another object of the present invention is to provide a drilling apparatus in which the rotary assembly hydraulic circuit and cathead hydraulic circuit have incorporated therein speed and directional limitations.

Another object of the present invention is to provide a drilling apparatus in which the rotation of the rotary assembly and cathead is immediately stopped when a shutdown circuit is energized.

Another object of the present invention is to provide a drilling apparatus in which the mast assembly can be automatically maintained in a vertical or other preselected angled position, regardless of its horizontal position relative to the bed of the support vehicle.

Another object of the present invention is to provide a drilling apparatus capable of drilling at selected, incremantal angles or drilling vertically when the support vehicle is positioned on a grade.

Another object of the present invention is to provide a drilling apparatus which can be used for both auger drilling and core drilling.

Another object of the present invention is to provide a drilling apparatus which incorporates a control panel which groups valve controls for limiting functions.

Another object of the present invention is to provide a drilling apparatus which can be operated safely and efficiently by two individuals.

Another object of the present invention is to provide a drilling apparatus which is capable of selectively delivering both high speed and/or high torque to the drilling rods.

Another object of the present invention is to provide a drilling apparatus which incorporates a hydraulic control circuit designed to lock all cylinders in place in the event of loss of power.

Another object of the present invention is to provide a drilling apparatus which utilizes a hydraulic system which is sealed and pressurized to eliminate the induction of contaminates.

Another object of the present invention is to provide a drilling apparatus which utilizes outriggers to stabilize the support vehicle during drilling operations.

Another object of the present invention is to provide a drilling apparatus, the hydraulically driven components of which are powered by hydraulic pumps mechanically linked to a power take-off assembly mounted on the support vehicle.

Another object of the present invention is to provide a drilling apparatus which is capable of immediately stopping the rotation of either the rotary assembly or the cathead when an electrical circuit is activated.

Another object of the present invention is to provide a drilling apparatus which includes a regenerative hydraulic circuit to operate the feed assembly.

Another object of the present invention is to provide a drilling apparatus which includes means to override the regenerative hydraulic circuit operating the feed assembly.

Other objects, features and advantages of the present invention will become apparent from the following description when taken in conjunction with the following drawings, wherein like reference characters designate corresponding parts throughout the several views.

DESCRIPTION OF THE PREFERRED EMBODIMENTS

Figure 1:
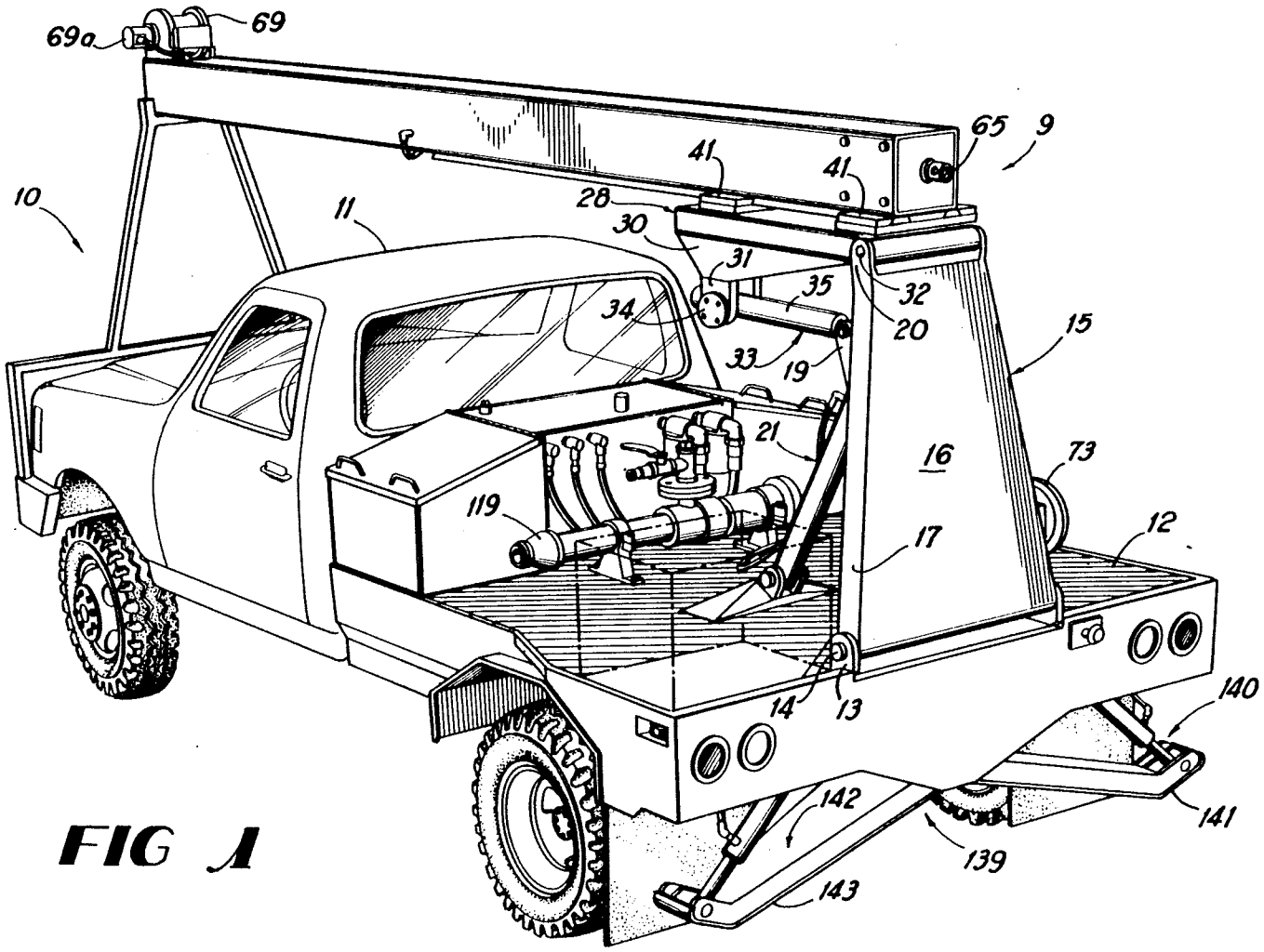
FIG. 1 is a perspective view of the drilling apparatus in a transport position.
Figure 2:
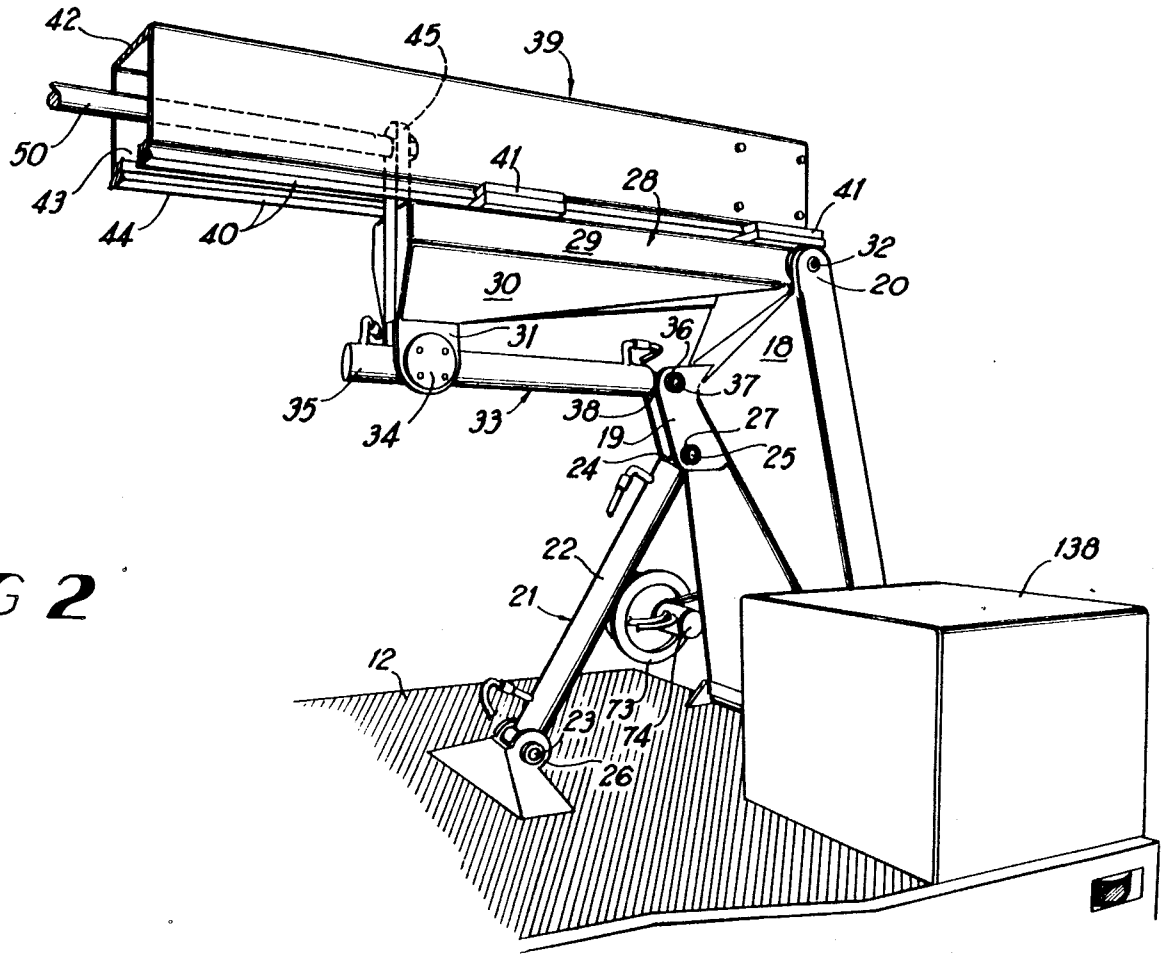
FIG. 2 is a perspective view of the link assembly with the mast assembly in a horizontal position.
Figure 3:
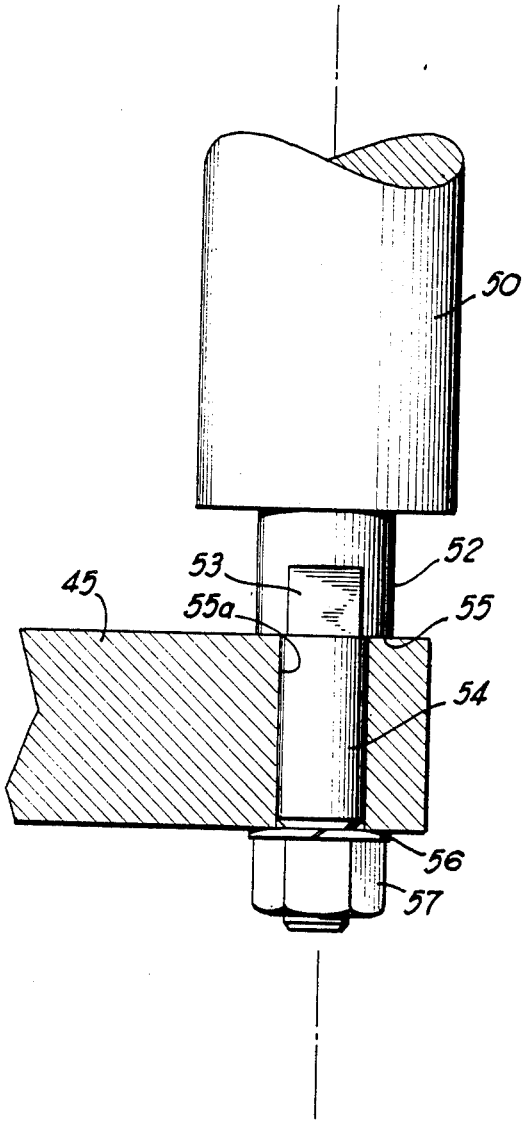
FIG. 3 is an enlarged view of the attachment of the feed assembly to the mast link.

Referring now in detail of the embodiments chosen for the purpose of illustrating the present invention, numeral 10 denotes generally a conventional truck 10 having cab 11 and flat bed 12. Drilling apparatus 9 is shown mounted onto flat bed 12 of truck 10. Securely mounted onto the rear portion of bed 12 are spaced, upstanding brackets 13. Each of spaced brackets 13 are preferably mounted onto bed 12 equidistantly from the side of bed 12 to which the respective bracket is closest. Pivotally mounted in brackets 13 by pins 14 is support member or off-hole link 15. As best shown in FIGS. 1 and 2, off-hole link 15 includes upstanding, tapered rear panel 16 and identical side panels 17. Securely attached to side panels 17 and extending toward cab 11 are triangular support brackets 18. Support brackets 18 are angled inwardly, as shown in FIG. 2, and securely support journal member 19, having lower holes 27 and upper holes 36. The top portion of side walls 17 terminate in identical upstanding brackets 20. Off-hole link 16 is actuated about pins 14 by off-hole cylinder assembly 21. Cylinder assembly 21 is a short stroke hydraulic piston and cylinder assembly including cylinder 22 having trunnions 23, and rod 24 having trunnions 25. As shown in FIG. 2, trunnions 23 are pivotally mounted in upstanding parallel spaced brackets 26, which brackets 26 are secured to bed 12. At the other end of cylinder assembly 21, trunnions 25 are received in the lower portion of journal member 19 through lower holes 27. Cylinder assembly 21 is preferably a short stroke hydraulic cylinder having a stroke limited to approximately 8 inches.

Pivotally attached to upper bracket 20 of off-hole link 16 is support member or mast link 28. Mast link 28 is symmetrical and includes identical side walls 29 and triangular supports 30 which terminate at brackets 31, as shown in FIG. 2. Pins 32 join mast link 28 to upstanding brackets 20, so that mast link 28 pivots about pins 32. Mast link cylinder assembly 33 is pivotally connected by trunnions 34 of cylinder 35 to bracket 31. Pivotally connected to journal member 19 by trunnions 37 being received in holes 36 is rod 38 of cylinder assembly 33.

Figure 4A:
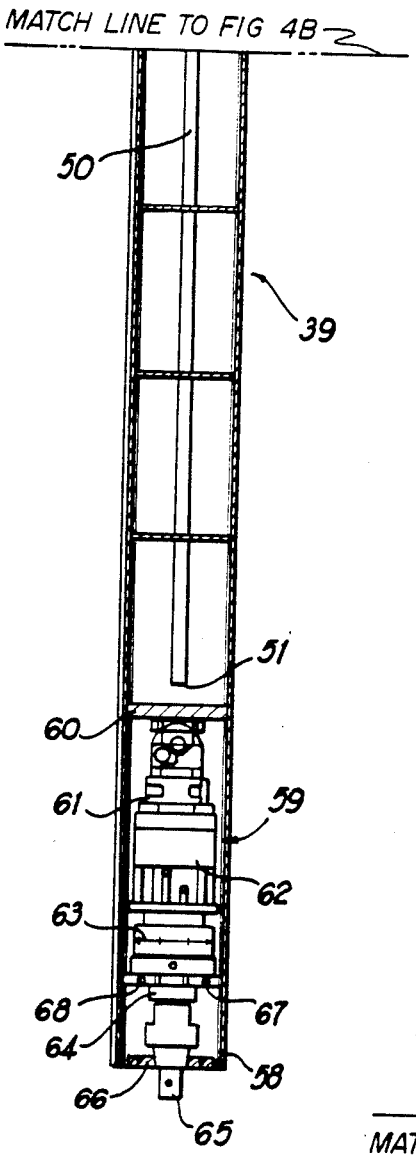
FIGS. 4A and 4B are a longitudinal cross-sectional views of the mast assembly.
Figure 4B:
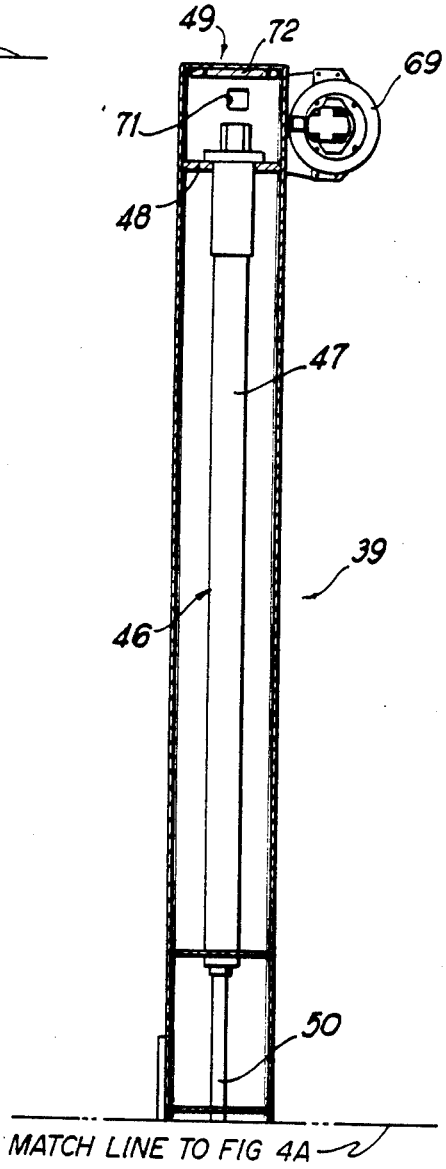

Mast assembly 39 slidably engages mast link 28 through dovetail runners 40 and dovetail clamps 41. Two identical dovetail runners 40 are secured to mast frame 42, as depicted in FIG. 2. These dovetail runners 40, communicate with dove tail clamps 41, so that mast assembly 39 is fixed to mast link 28. The engagement of runners 40 and clamps 41 permit mast assembly 39 to slide along mast link 28 but do not permit mast assembly 39 to tilt or fall away from mast link 28. Mast frame 42 is preferably formed of box steel and is square shaped in cross-section and defines channel 43 within its back side 44, as depicted in FIG. 2. One dovetail runner 40 is mounted onto mast frame 42 on each side of and parallel to channel 43. Mast link 28 includes cradle 45 which extends into channel 43 of mast frame 42. Mast assembly 39 is depicted in FIG. 4 in longitudinal cross-section. Mounted entirely within mast frame 42 is feed cylinder assembly 46. Cylinder assembly 46 is securely mounted to plate 48 which is attached within mast frame 42 at its upper end 49. Cylinder 47 and rod 50 extend within frame 42, as shown in FIGS. 4A and 4B. The free end 51 of rod 50 includes boss 52 with flattened surface or wrench flat 53. Shaft 54 extends from and is concentric with boss 52 and is of a smaller diameter than boss 52, thus forming shoulder 55. Shaft 54 is externally threaded and is received within hole 55A of cradle 45, until shoulder 55 abuts cradle 45. Shaft 54 is long enough to extend through cradle 45 and is secured to cradle 45 with lock washer 56 and nut 57.

Mounted within the lower end 58 of mast frame 42 is rotary assembly 59. Rotary assembly 59 includes spacer plate 60 which is secured to variable-displacement motor 61. Linked to motor 61 is two-speed gear box 62. Linked to gear boss 62 is planetary gear 63 which is a fixed ratio planetary gear. A tapered key shaft with a threaded nut (not shown) extends from planetary gear 63. Attached to the tapered key shaft is spindle adapter 64 with spindle 65 extending from the bottom portion 58 of frame 42. The variable speed motor 61, gear box 62, planetary shift 63 and spindle adapter 64 are all mechanically linked, the structure of which linkage is well known in the art and is not further described herein. Cover plate 66 encloses the bottom end 58 of frame 42. Cover plate 66 is provided with a centrally disposed hole so that only spindle 65 protrudes therefrom. Therefore, with the exception of spindle 65, rotary assembly 59 is completely enclosed within mast frame 42. This is an important safety feature as in the present invention there are much fewer moving parts associated with the rotary assembly for operators to come in contact with. Since motor 61 is centrally mounted onto spacer plate 60, spacer plate 60 assists in maintaining rotary assembly 59 in a central longitudinal alignment within mast frame 42. Rotary assembly 59 is securely fixed to mast frame 42 by bolts 67 extending through mounting plate 68 which is securely fixed to rotary assembly 59.

Figure 6:
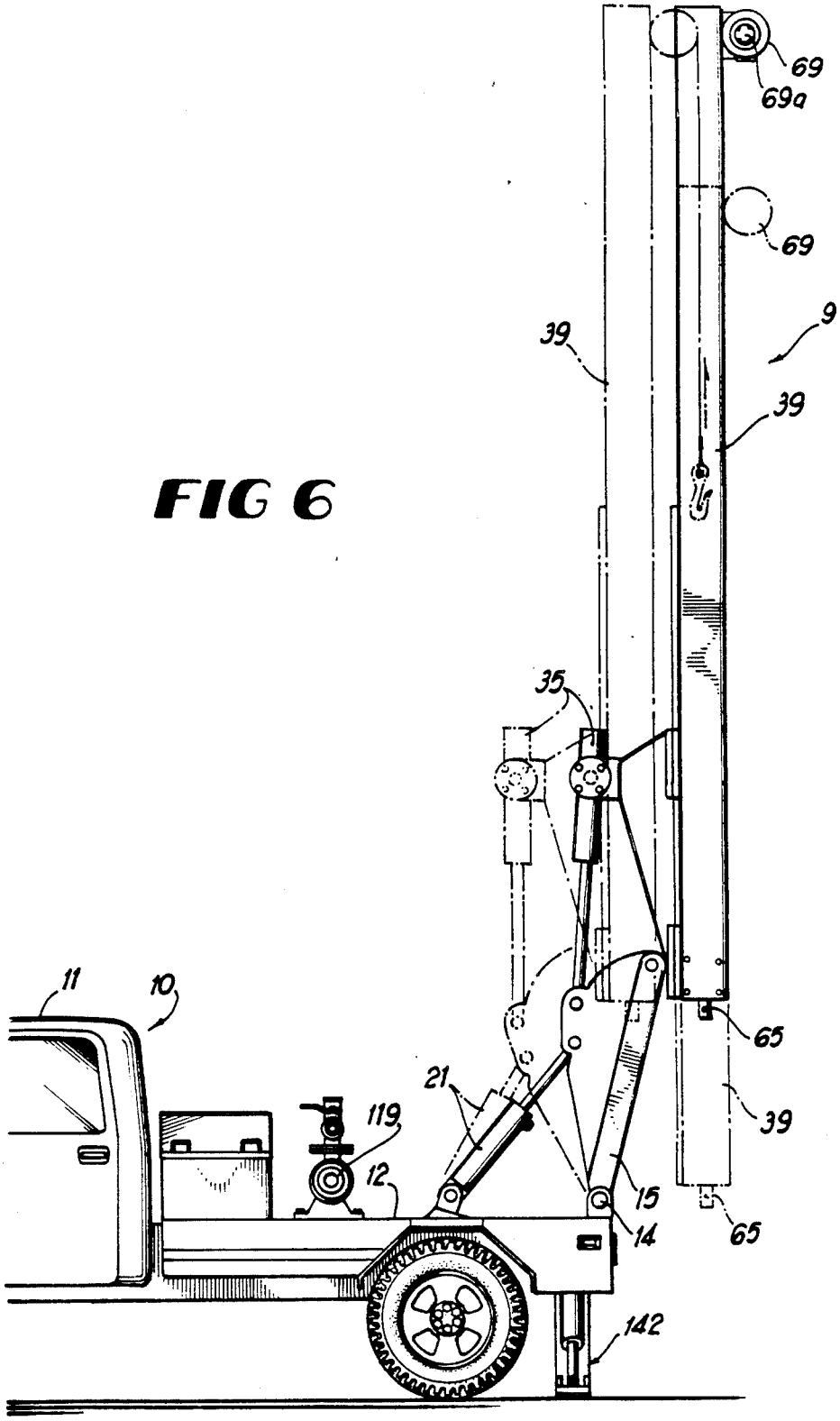
FIG. 6 is a side elevational view of the drilling apparatus in an on-hole position, with the apparatus in an off-hole position shown in phantom lines.

Hydraulic winch 69 is secured to the upper end 49 of mast frame 42, as depicted in FIG. 4, so that when mast frame 42 is in its vertical position, winch 59 faces away from truck 10, as shown in FIG. 6. Mounted on the side of plate 48, away from cylinder 47, is hydraulic fluid counter-balance valve 70. Counter-balance valve 70 permits hydraulic fluid to exit from cylinder 47 above piston 50, normally only when that hydraulic circuit is powered, when a sufficient external force is applied to mast assembly 39 or in case of extreme thermal conditions, as will be discussed hereinafter. Also mounted within mast frame 42 at its upper end 49 is electronic level 71, which functions in conjunction with the hydraulic control circuit 100 to automatically maintain the mast assembly 39 at a preselected angle, as will be discussed hereinafter. Cover plate 72 is mounted on the top end 49 of frame 42 to fully enclose frame 42.

Capstan or cathead drum 73 is journaled on a shaft extending from hydraulically powered motor 74, which is securely mounted to off-hole link 18, as shown in FIG. 2.

Figure 5A:
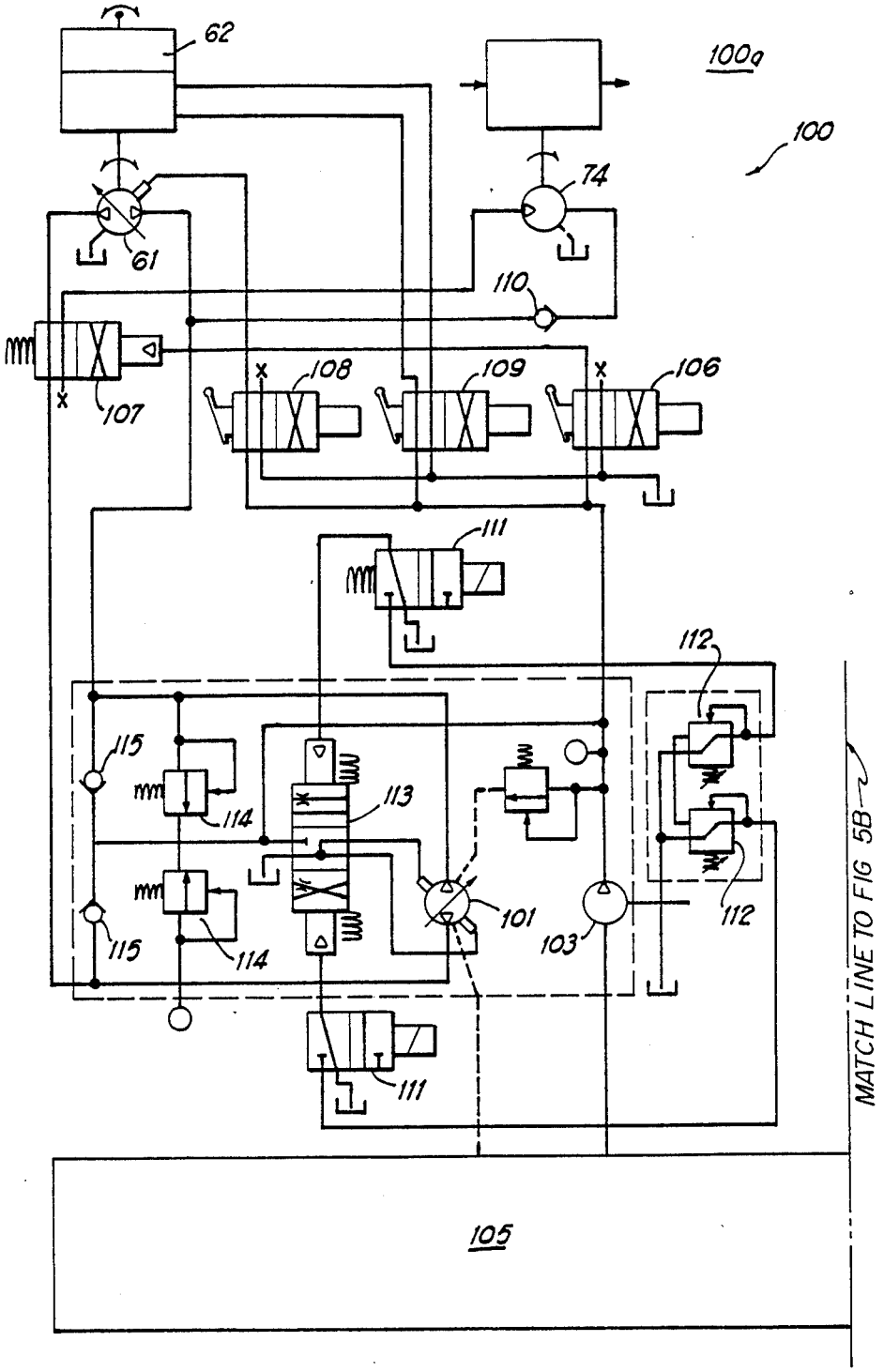
FIGS. 5*a*, 5*b*, and 5*c* are schematic representations of the hydraulic control circuit.
Figure 5B:
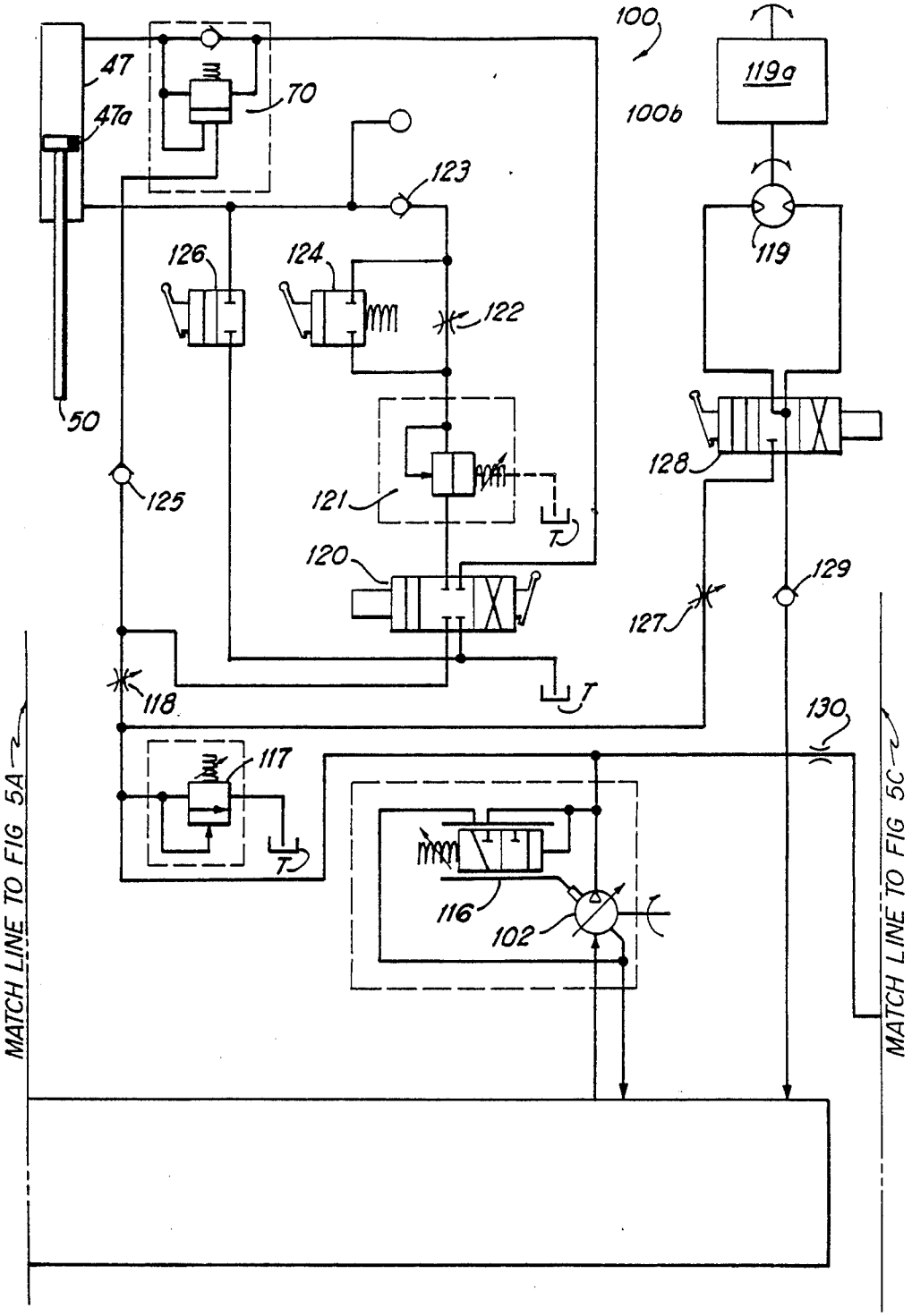
Figure 5C:
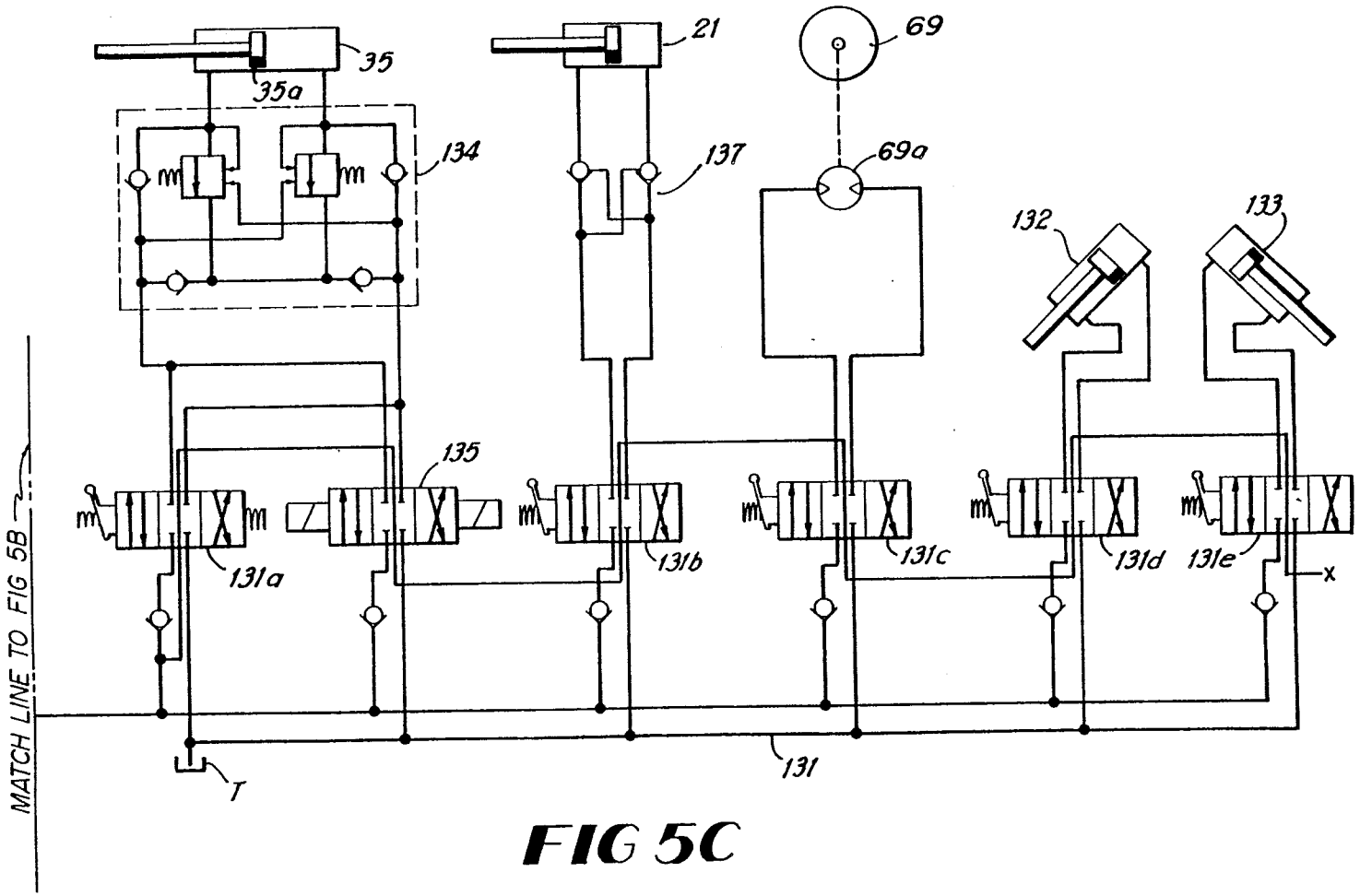

The entire drill rig assembly is powered principally by hydraulic pumps, cylinders and motors, and incorporates a hydraulic circuit as depicted in schematic form on FIGS. 5*a*, 5*b*, and 5*c*, which figures align according to their respective match lines. The hydraulic circuit incorporates a combination of known elements which are connected by conventional hydraulic lines are well known to those skilled in the art, and so are not further described herein. The valves and other control elements contained in the hydraulic circuit are also conventional elements well known in the art, however, their particular arrangement within the present invention is designed to increase the safety and efficiency of the present invention. Referring to FIGS. 5*a*, 5*b*, and 5*c*, the hydraulic circuit, denoted generally on the three figures and numeral 100, includes main pumps 101 and 102 and charge pump 103 which collectively provide hydraulic pressure within the entire circuit 100. Pumps 101, 102 and 103 are driven mechanically by a power take-off gear box (not shown) incorporated with the transmission (not shown) of truck 10. Such power take-offs and the engine controls and the engine protection devices associated therewith are generally well known by those skilled in the art, and are not further discussed herein.

Main pump 101 and charge pump 103 are responsible for providing hydraulic pressure and flow to the circuit which includes the rotary assembly 59 and the hydraulic cathead motor 74. Charge pump 103 is a constant displacement pump which maintains a positive pressure at the suction port of main pump 101. Charge pump 103 provides a constant flow of fluid through the fluid conditioning circuit 105, and also provide the pressure for the remote control of displacement of rotary motor 61, gear box 62, and valve 106 and also controls flow rate and direction of fluid from pump 101.

Pump 101 is connected to relief valve 104 which feeds fluid in the circuit to a fluid reservoir or tank T which is included generally in the hydraulic fluid conditioning circuit denoted generally as numeral 105. Hydraulic conditioning circuit 105 contains conventional elements of hydraulic conditioning including radiators, hydraulic fluid filters, the hydraulic fluid reservoir or tank T, and the necessary relief valves and check valves associated therewith. These elements are widely known in the art and understood by those skilled in the art and, therefore, will not be further discussed herein.

When pumps 101 and 103 are operating, the hydraulic circuit 100*a* is pressurized, preferably to 230 p.s.i. to 5,000 p.s.i. Manual control valve 106 is a directional control valve which directs fluid at 230 p.s.i. pressure to shuttle valve 107. Shuttle valve 107 is a pilot operated three-way valve which allows pressurized fluid to operate either the rotary assembly 59, the cathead motor 74, or neither of these elements. Therefore, neither of the rotary assembly 59 or the cathead motor 74 can operate simultaneously. This is a safety feature which is built into the device to prevent the operator from operating the rotary assembly 59 and watching the drilling operation while the cathead 73 is in a hoisting operation. In the past, operators have been injured while both of these operations were being conducted simultaneously. With the present invention, this would be impossible. When the rotary assembly 59 is selected for rotation by valve 106, pressurized hydraulic fluid is directed through shuttle valve 107 to variable displacement motor 61. As discussed earlier, variable displacement motor 61 is mechanically connected to gear box 62. Manual control valve 108 directs the pilot pressure to variable displacement motor 61 in order to control the displacement of motor 61. Motor 61 is preset to 100% displacement or approximately 40% displacement. Manual control valve 109, sends pilot pressure to gear box 62 in order to shift gears from a high range of 1 to 1, to a low range of 3.46 to 1. Manual valve 108 shifts the displacement in variable displacement motor 61 from either 100% displacement to 40% displacement. Since the variable displacement motor 61 and two-speed gear box 62 are in series, the rotary assembly 59 is capable of turning at four different speed ranges. Each range is controlled by varying the speed with pump displacement.

Manual control valve 106 is a dual pressure regulating valve with the following functions: incrementally increase fluid flow to the rotary assembly 59 in a full clockwise direction, reverse the rotary assembly 59 in a counterclockwise direction, incrementally increase fluid flow to the cathead motor in a forward direction, or stop all fluid flow to the rotary assembly 59 or the cathead motor 74.

Manual valve 106 also can be operated to actuate shuttle valve 107 to direct fluid to cathead motor 74 which drives cathead drum in a counterclockwise direction, only. Ball valve 110 prevents hydraulic fluid from entering motor 74 and driving cathead drum in the opposite direction. This is a safety feature which eliminates the obvious danger of turning the cathead drum in the opposite direction. The control panel (not shown) limits the travel of manual valve 106 in one direction which allows the rotary assembly to be energized in the reverse direction at only approximately 15% of the full speed of the forward direction. This is an additional safety feature.

In case of an emergency situation associated with the rotary assembly 59 or the cathead 73, solenoid shuttle valve 111 is provided as an emergency stop switch to immediately stop the rotation of either rotary assembly 59 or cathead 73. Hydraulic pressure from pump 103 is reduced in pressure regulator 112, for pilot pressure to solenoid directional control valve 111. When solenoid shuttle valve 111 is deenergized, hydraulic pressure is delivered to servo valve 113 which delivers pressure to swash plates in pump 101 to drive the swash plate to 0 degrees. Fluid flow from pump 101 is immediately stopped in the rotary assembly 59 and/or cathead 73, depending which is being utilized at the time, is immediately stopped from turning. Also associated with pump 101 are the necessary relief valves 114 and ball valves 115 to assist in the maintenance of the proper pressure and directional flow, respectfully in the hydraulic circuit. Their function is well known to those skilled in the art.

Mechanically driven pump 102 provides hydraulic pressure for the remaining hydraulic components of the drilling assembly. The hydraulic circuit for feed assembly 46 and water pump 119 is denoted generally by numeral **100*b*. Pressure compensated valve 116 monitors the pressure in the circuit and controls pressure to the swash plate control which is integral to conventional hydraulic pump 102, to ensure that the circuit is maintained at a proper pressure, preferably approximately 2,500 p s.i. Relief valve 117 acts as a backup to pressure compensated valve 116 to ensure that the circuit is not over pressurized. Relief valve is preferably set at approximately 2,600. Should the circuit for some reason pressurize over this limit, relief valve will open and direct fluid to tank T in fluid conditioning circuit 105. Fluid flow control 118 is preset to limit the fluid flow entering the feed cylinder assembly 46 and hydraulically powered water pump 119. Preferably fluid flow control valve 118 is set to permit approximately 11 gallons per minute of hydraulic fluid flow through valve 118. Manually operated detent control valve 120 allows fluid to enter the hydraulic lines servicing feed assembly 46. Adjustable relief valve 121 selectively, incrementally controls the pressure applied by feed assembly 46, commonly referred to as bit pressure. Adjustable flow control valve 122 controls the speed or rate of downward feed assembly travel. As shown in FIG. 5*b*, fluid passes through adjustable flow control valve 122 through ball valve 123 and into cylinder 47 below piston 47*a*. As fluid enters cylinder 47 from flow control 122, piston rod 50 is retracted into cylinder 47 and mast frame 42 is then forced downwardly. Counterbalance valve 70 is also actuated when fluid flows through adjustable flow control valve 122. Counterbalance valve 70 is a conventional spring biased counterbalance valve of a type which is well known in the art, and is designed to prevent hydraulic fluid from exiting cylinder 47 above piston 47A, unless the counterbalance valve is powered. Practically, this ensures that feed cylinder assembly 46, and therefore mast assembly 39, is retained in a fixed position until control valve 122 is actuated. This is a safety feature which prevents the mast frame 42 from dropping upon loss of power. When counterbalance valve 70 is powered by fluid passing through ball valve 123, fluid is allowed to bleed from cylinder 47 above piston 47A and back to tank T in circuit 105. Temporary override valve 124 is provided to allow adjustable flow control valve 122 to be manually bypassed, thereby allowing relatively increased flow through ball valve 123 and into cylinder 47 in order to permit the mast frame 42** to be dropped quickly. This feature is desirable when, for example, new sections of drill rods are being added, in order to save time.

Manually operated detent valve 120 can also be actuated to bypass adjustable relief valve 121, in order to direct fluid through counterbalance valve 70 and into cylinder 47 above piston 47A. When fluid is directed into cylinder 47 above piston **47*a*, rod 50 is extended from cylinder 47, and mast frame 42 is raised. As fluid so enters cylinder 47, piston 47A is pushed downwardly and fluid below piston 47A is pushed out of cylinder 47 through ball valve 125 and join the fluid flowing from fluid flow control valve 118. This is, thus, a regenerative type circuit which is well known in the art, and thus increases the flow rate entering cylinder 47 above piston 47A relative to the situation when fluid is directed into cylinder 47 below piston 47A. Because fluid flow control valve 118 is preferably set to allow 11 gallons per minute (g.p.m.) of fluid flow into the circuit, this regenerative circuit allows 22 g.p.m. to enter cylinder 47 above piston 47*a*. Since the area of the bore of cylinder 47A is twice the area of piston rod 47, directing twice the amount of fluid into cylinder 47 above piston 47A results in the feed cylinder assembly 46 raising and lowering the mast frame 42** at approximately the same rate.

Manually operated detent valve 126 is provided to circumvent the above-described regenerative circuit. When valve 126 is actuated, and valve 120 is directing fluid into cylinder 47 above piston 47A, the fluid exiting cylinder 47 below piston 47A is directed through valve 126 at approximately zero resistance, back to tank T in circuit 105. Therefore, only approximately 11 g.p.m. of fluid will flow into cylinder 47 above piston 47A. Because the area of the bore of cylinder 47 is approximately twice the area of piston rod 50, rod 50 will be forced out of cylinder 47 at only half of its normal, full rate and at twice the normal force. This is useful when, for instance, the operator needs to raise the mast assembly 39 at a greater force and slower speed in order to pull drill rods which are stuck.

Pump 116 also delivers pressurized fluid through flow control valve 127 to manually operated control valve 128. Valve 128 is a detent valve in two positions, stop and run, and a spring biased valve for a reverse flush function. When valve 128 is actuated, pressurized fluid is directed through water pump motor 119 and is circulated back through ball valve 129 to fluid conditioning circuit 105.

Pump 116 also directs pressurized fluid through fixed flow control valve 130 to a conventional multisectional, directional control valve block 131. This control valve block is a conventional, off the shelf product, such as that manufactured by the Gresen Manufacturing Company, and will not be further discussed herein, except that the block includes five manually controlled spring biased control valves. These valves control the fluid flow to the hydraulic circuit denoted generally with reference numeral 100C. Control valve 131A controls the mast cylinder assembly 46, control valve 131B controls the off-hole cylinder assembly 21, control valve 131C controls the winch 69, control valve 131D controls left outrigger jack assembly 139 and control valve 131E controls right outrigger jack assembly 142. Fluid from manual control valve 131A is selectively directed through counterbalance valve 134 into mast cylinder 35. Counterbalance valve 134 is a conventional counterbalance valve, similar to counterbalance valve 70, and functions to prevent fluid from exiting mast cylinder 35 both above and below piston 35A, unless counterbalance valve 134 is powered. This is a safety feature which normally prevents mast assembly 39 from changing positions unless manually operated control valve 131A is actuated, or unless automatically powered by double solenoid valve 135. Double solenoid valve 135 is electronically linked to electronic level or plumb bob sensor 71 contained in mast frame 42. Electronic level 71 is a conventional electronic plumb bob level which sends an electric signal when the level is placed in a preselected position. When electrical switch 136 is biased, energizing electronic level 71, electronic level 71 will automatically send a signal to the appropriate side of double servo valve 135, which in turn hydraulically actuates the counterbalance valve 134 which allows fluid to flow through counterbalance valve 134 into mast cylinder 35 above or below piston 35A as needed to orient mast assembly 39 in the proper position. Thus, mast assembly 39 is actuated in one direction or the other, until mast assembly 39 reaches a preselected angle programmed into electronic level 71. This provides an automatic override circuit in order to automatically position and maintain mast assembly 39 in an appropriate angle. Those skilled in the art understand that electronic switch 136 can be eliminated and the entire automatic positioning system can be made fully automatic.

Conventional multisectional direction control valve 131 is designed so that valves 131A, 131B, 131C, 131D, and 131E are arranged in parallel so that the function controlled by these valves can be conducted simultaneously. Manual control valve 131B controls off-hole cylinder assembly 21 by directing fluid to cylinder 22 through double check valve 137. Manually operated control valve 131C operates the winch motor 69A to turn winch 69 in either direction. The winch motor and brake for winch 69 are not shown, however, the winch motor is integral with the winch brake and is a conventional, hydraulically powered winch. Manually operated control valve 131D operates left outrigger cylinder assembly 140, and manually operated control valve 131E operates right outrigger cylinder assembly 142.

Those skilled in the art will understand that the hydraulic control system described herein can be modified in numerous ways using conventional hydraulic and/or electronic components. The control circuit described herein is described for the purpose of illustration, only, and other circuits can perform satisfactorily if those circuits incorporate appropriate components for the safety features disclosed herein.

Control box 138 houses the various gauges and mechanically operated controls discussed above. This control box is positioned as far away from the mast assembly as possible, while still providing the operator with an unobstructed view of the drilling operations. All functions of the assembly 9 are controlled by the manually operated valves contained in control box 138 except for the second emergency shut-down switch, the power take-off engaging lever, and certain motor circuit valves.

The vehicle 10 is stabilized by outrigger assembly 139 which consists of left outrigger cylinder assembly 140 left outrigger jack 141, right outrigger cylinder assembly 142, and right outrigger jack 143, as shown in FIG. 1. These outrigger jacks 141 and 142 are conventional stabilizing jacks, but provide the advantage of more stability over vertically disposed stabilizing jacks normally utilized in drilling apparatus of the prior art.

The various components relating to the drill rods and the water hose connections from the drill rods to the water pump 119A are not part of the present invention and are, therefore, not depicted. Those skilled in the art understand how these components are utilized with drilling apparatus 9.

In operation, the vehicle 10 is positioned so that mast assembly 39 can be raised over a selected location for drilling. Outrigger assembly 139 is then actuated to stabilize vehicle 10. The operator then actuates mechanically operated control valve 131A to raise mast cylinder into a vertical position, as is depicted in FIG. 6. When the mast assembly 39 is in a nearly vertical position, the operator will bias electronic switch 136 which sends electronic signals to electronic level 71, which in turn controls double servo valve 135. Double servo valve 135 then maintains mast assembly 39, in a predetermined angled position, as described above. The mast assembly 39 depicted in phantom lines in an off-hole position in FIG. 6, can then be actuated by manually operated control valve 131B to move mast assembly 39 horizontally, onto an on-hole position as depicted in FIG. 6. During this procedure, the mast assembly 39 is maintained in the predetermined, angled position by electronic level 71, as described above. The mast can then be lowered for the attachment of drill rods (not shown) and the drilling operation can commence.

It will be obvious to those skilled in the art that many variations may be made in the embodiments here chosen for the purpose of illustrating the present invention, and full result may be had to the doctrine of equivalents without departing from the scope of the present invention, as defined by the appended claims.

What is claimed is:

1. A drilling apparatus for driving a drill rod into a selected location, comprising:

(a) a mast frame;

(b) actuating means attached to said mast frame for moving said mast frame in a position adjacent to said selected location;

(c) rotary means contained within said mast frame for rotating said drill rod; and (d) feed means positioned within said mast frame and concentrically aligned with said drill rod and being disposed above said drill rod when said mast frame is in a vertical position for pushing and pulling said drill rod toward and away from said selected location.

2. The apparatus defined in claim 1, wherein said actuating means is also capable of selectively actuating said mast assembly at incremental position from a vertical position to a horizontal position.

3. The apparatus defined in claim 1, wherein said actuating means is comprised of a first link assembly, a second link assembly pivotally connected to said first link assembly and also pivotally connected to said mast assembly.

4. The apparatus defined in claim 3, wherein said actuating means includes a first cylinder assembly attached to said first link assembly and a second cylinder assembly attached to said second link assembly for moving said first and second link assemblies to selected positions.

5. The apparatus defined in claim 1, wherein said feed means selectively raises and lowers said mast assembly at incremental positions when said mast assembly is in a vertical position.

6. The apparatus defined in claim 1, wherein said feed means consists of a hydraulic cylinder means.

7. The apparatus defined in claim 1, and counterbalance valve means attached to said hydraulic cylinder means for controlling the flow of fluid into and out of said hydraulic cylinder means.

8. The apparatus defined in claim 1, wherein said rotary means is comprised of a hydraulic motor, a gear box assembly mounted to said hydraulic motor in longitudinal relationship, and a spindle adapter attached to said gear box assembly in longitudinal relationship therewith.

9. The apparatus defined in claim 1, wherein said actuating means includes a guide and wherein said mast assembly includes a flange for being received within said guide for slidable movement in said guide, whereby said mast assembly is in slidable relationship with respect to said actuating means.

10. The apparatus defined in claim 1, wherein said actuating means includes an arm and wherein said mast assembly defines a channel, said arm being received within said channel for attachment to said feed means.

11. The apparatus defined in claim 10, whereby said mast assembly is raised and lowered, when in a vertical position, by the force applied by said feed means onto said arm.

12. The apparatus defined in claim 1, wherein said mast assembly includes an electronic level means mounted therein for automatically maintaining said mast assembly in a predetermined, selected position.

13. The apparatus defined in claim 1, including hydraulic circuit means connected to said mast assembly, said actuating means, said rotary means and said feed means for controlling their respective movement.

14. The apparatus defined in claim 13, including hydraulic control for selectively controlling the flow of fluid in said hydraulic circuit means.

15. The apparatus defined in claim 1, hereby said mast assembly includes a winch.

16. The apparatus defined in claim 1, whereby said mast assembly includes a cathead mounted on the off-hole link assembly.

17. The apparatus defined in claim 16, wherein said cat head cannot turn while said rotary means is turning.

18. A drilling apparatus for driving a drill rod into a selected location, comprising:

(a) an elongate mast frame having an upper end portion and a lower end portion and defining a chamber;

(b) actuating means attached to said elongate mast frame for moving said lower end portion of said mast from adjacent to said selected location;

(c) rotary means for rotating said drill rod attached to said mast frame and positioned within said chamber at said lower end portion of said mast frame, said drill rod being attached to said rotary means; and (d) feed means positioned within said chamber at said upper end portion of said mast frame and adjacent to said rotary means and in concentric alignment with said drill rod for pushing and pulling said drill rod.

* * * * *